US010309740B2

(12) United States Patent
Fishbein et al.

(10) Patent No.: US 10,309,740 B2
(45) Date of Patent: Jun. 4, 2019

(54) DEVICE AND METHOD FOR LOCKING AND CONTROLLING A WEAPON

(71) Applicant: ZORE LIFE SHAPING SOLUTIONS LTD., Jerusalem (IL)

(72) Inventors: Yalon Fishbein, Kibbutz Afikim (IL); Yonatan Zimmerman, Jerusalem (IL)

(73) Assignee: ZORE LIFE SHAPING SOLUTIONS LTD., Jerusalem (IL)

( * ) Notice: Subject to any disclaimer, the term of this patent is extended or adjusted under 35 U.S.C. 154(b) by 0 days.

(21) Appl. No.: 15/537,685

(22) PCT Filed: Dec. 9, 2015

(86) PCT No.: PCT/IL2015/051192
§ 371 (c)(1),
(2) Date: Jun. 19, 2017

(87) PCT Pub. No.: WO2016/103249
PCT Pub. Date: Jun. 30, 2016

(65) Prior Publication Data

US 2017/0350667 A1 Dec. 7, 2017

(30) Foreign Application Priority Data

Dec. 22, 2014 (IL) ..... 236394

(51) Int. Cl.
*F41A 17/44* (2006.01)
*F41A 17/06* (2006.01)
(Continued)

(52) U.S. Cl.
CPC ..... *F41A 17/44* (2013.01); *F41A 17/06* (2013.01); *F41A 17/063* (2013.01); *F41A 17/46* (2013.01); *F41A 19/00* (2013.01)

(58) Field of Classification Search
CPC ..... F41A 17/44; F41A 17/063; F41A 17/06
See application file for complete search history.

(56) References Cited

U.S. PATENT DOCUMENTS 5,054,233 A 10/1991 Lee
5,115,589 A 5/1992 Shuker
(Continued)

FOREIGN PATENT DOCUMENTS

CA 2142399 A1 8/1996
CN 104034202 A 9/2014
(Continued)

OTHER PUBLICATIONS

Schuster, Mark A., et al. "Firearm Storage Patterns in U.S. Homes with Children," 90 Am. J. Pub. Health 588, 590 (Apr. 2000).
(Continued)

*Primary Examiner* — Stephen Johnson
(74) *Attorney, Agent, or Firm* — Dorsey & Whitney LLP

(57) ABSTRACT

Some aspects of the invention are related to a locking device for a firearm and a method of controlling such a locking device. The locking device may include a locking cartridge adapted to be inserted into a firing chamber of the firearm, the locking cartridge may include a cartridge-like housing and a locking mechanism located in the cartridge-like housing. In some embodiments, when the locking mechanism is in an unlocked state, the locking mechanism may be extractable from the firearm's firing chamber, by cocking the firearm and when the locking mechanism is in a locked state, cocking the firearm may fasten the locking mechanism in the firearm's firing chamber. The locking device may further include an actuator adapted to change the state of the locking mechanism between the locked state and the unlocked state and a controller, in active communication with the actuator, configured to operate the actuator according to a signal received from an input device. In some embodiments, the locking cartridge, the actuator and the controller are extricable from the firearm together as a single unit.

20 Claims, 4 Drawing Sheets

(51) Int. Cl.
*F41A 17/46* (2006.01)
*F41A 19/00* (2006.01)

(56) References Cited

U.S. PATENT DOCUMENTS

| | | | | |
|---|---|---|---|---|
| 5,303,495 | A | 4/1994 | Harthcock | |
| 5,331,759 | A | 7/1994 | Marceau et al. | |
| 5,419,069 | A | 5/1995 | Mumbleau et al. | |
| 5,950,344 | A * | 9/1999 | Ross | F41A 17/44 42/70.11 |
| 6,250,008 | B1 | 6/2001 | Silver | |
| 6,308,450 | B1 * | 10/2001 | Ireblad | F41A 17/44 42/70.02 |
| 6,405,472 | B1 | 6/2002 | Dojcsak | |
| 6,412,207 | B1 | 6/2002 | Crye et al. | |
| 6,499,244 | B1 | 12/2002 | Smith et al. | |
| 6,502,344 | B1 | 1/2003 | Zeh et al. | |
| 6,560,910 | B1 | 5/2003 | McLaren | |
| 6,591,532 | B1 | 7/2003 | Gilbertson et al. | |
| 6,711,844 | B2 * | 3/2004 | Rumfelt | F41A 17/063 42/70.11 |
| 9,222,742 | B2 * | 12/2015 | Steuwer | F41A 17/44 |
| 2002/0059746 | A1 | 5/2002 | Ross et al. | |
| 2002/0170222 | A1 | 11/2002 | Alanko | |
| 2006/0288624 | A1 | 12/2006 | Ha | |
| 2011/0119890 | A1 | 5/2011 | Steuwer et al. | |
| 2011/0290103 | A1 | 12/2011 | Herrmann et al. | |

FOREIGN PATENT DOCUMENTS

| | | | |
|---|---|---|---|
| DE | 202010000924 | * | 6/2011 |
| RU | 2505772 | | 1/2014 |
| WO | 0025081 A1 | | 5/2000 |

OTHER PUBLICATIONS

International Search Report and Written Opinion from International Application No. PCT/IL2015/051192 dated Mar. 7, 2016.

* cited by examiner

DEVICE AND METHOD FOR LOCKING AND CONTROLLING A WEAPON

BACKGROUND OF THE INVENTION

Safe storage of firearms became a high priority issue in recent years. A study made in the year 2000 on firearm storage patterns of families having children that has at least one firearm in a possession of the parents yield that, 55% of the families reported to have one or more firearms in an unlocked place and 43% reported keeping guns without a trigger lock in an unlocked place (Mark A. Schuster et al., Firearm Storage Patterns in U.S. Homes with Children, 90 Am. J. Pub. Health 588, 590 (April 2000)).

Unsafe storage of unlocked firearms can lead to deadly accidents involving children, parents and other people. Even at security or military organizations, where the use of firearms is widely common and done by professionals, deadly accidents due to unsafe storage or carless use of firearms occasionally happened.

A solution for unsafe storage of firearms is the use of a reliable locking device for locking each of the firearms one has in his possession. The locking device should be easy to operate, should be safe and should ensure that only the person authorized to use that firearm can unlock the locking device. There are several known locking devices, most of them use various mechanical locks that lock the trigger, block the firing chamber or block a magazine from being inserted into the firearm. Some of the locking devices have systems for identifying the authorized user, for example, by using a dial or a key. However, these techniques require to have the key or to remember a code to be dialed.

Most users, these days, carry mobile devices, such as a mobile phone, a tablet, a laptop or the like. Such a mobile device may be used to identify the user, for example, when operating an application for automatic parking payment. Smart mobile phones are usually equipped with a localization sensor, such as Global Positioning System (GPS) antenna, that allows detecting the location of the mobile phone.

SUMMARY OF THE INVENTION

Some aspects of the invention are related to a locking device for a firearm. The locking device may include a locking cartridge adapted to be inserted into a firing chamber of the firearm, the locking cartridge may include a cartridge-like housing and a locking mechanism located in the cartridge-like housing.

In some embodiments, when the locking mechanism is in an unlocked state, the locking mechanism may be extractable from the firearm's firing chamber, by cocking the firearm. When the locking mechanism is in a locked state, cocking the firearm may fasten the locking mechanism in the firearm's firing chamber. The locking device may further include an actuator adapted to change the state of the locking mechanism between the locked state and the unlocked state and a controller, in active communication with the actuator, configured to operate the actuator according to a signal received from an input device. In some embodiments, the locking cartridge, the actuator and the controller are extricable from the firearm together as a single unit.

Some additional aspect of the invention may be related to a method of controlling a locking device for locking a firearm. The method may include receiving a first signal from an input device to lock the locking device, the locking device comprising a locking cartridge, an actuator and a controller, and operating the actuator to lock the locking device inside a firing chamber of the firearm using a locking mechanism.

In some embodiments, the method may further include receiving a second signal from the input device to unlock the locking device, and operating the actuator to unlock the locking device inside the firing chamber by releasing the locking mechanism.

In some embodiments, when the locking mechanism is in an unlocked state, the locking mechanism may be extractable from the firearm's firing chamber, by cocking the firearm and when the locking mechanism is in a locked state, cocking the firearm may fasten the locking mechanism in the firearm's firing chamber.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
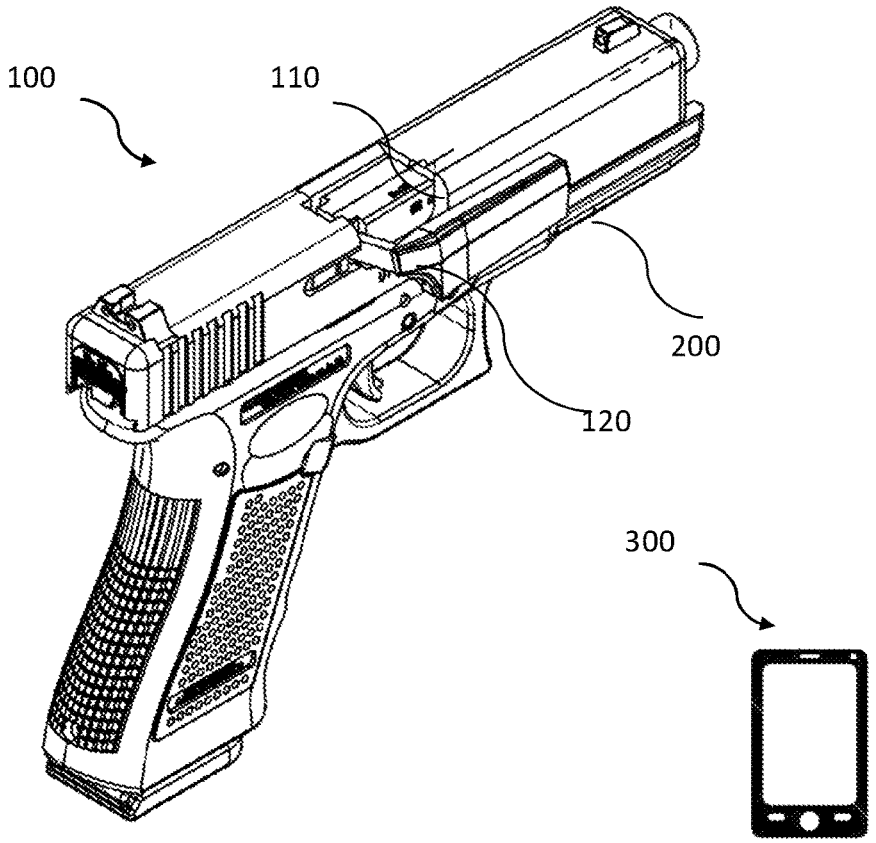
FIGS. 1A-1B are illustrations of an exemplary locking device inserted in an exemplary firearm according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like.

Unless explicitly stated, the method embodiments described herein are not constrained to a particular order or sequence. Additionally, some of the described method embodiments or elements thereof can occur or be performed at the same point in time or overlapping points in time. As known in the art, an execution of an executable code segment such as a function, task, sub-task or program may be referred to as execution of the function, program or other component.

Some aspects of the present invention may be related to a locking device for firearms (e.g., semi-automatic firearms) that may be operated by an owner or a user of the firearm (i.e., an authorized user) using a remote controller, for example, a mobile phone. The locking device may be operated to be locked or unlocked using an application running on the mobile phone (or on other mobile devices) of the authorized user. Each locking device may be associated with a particular mobile phone (e.g., by identifying the mobile phone number). The mobile phone may communicate with the locking device using any wireless communication, such as, Bluetooth communication, Infrared communication, Cellular communication, or the like. For example, when the user inserts the locking device into a firing chamber of the firearm, the user may run an application on his mobile phone and select to lock the locking device. Only a mobile phone associated with the particular locking device can cause the locking device to be locked and vice versa, only the mobile phone associated with the particular locking device can cause the locking device to be unlocked, thus preventing any unauthorized user from unlocking the firearm.

In some embodiments, the locking device may not be unlocked if the associated mobile phone is located more than a predefined distance away from the locking device. For example, if the mobile device associated with the locking device, such as a smartphone of the firearm's owner, is located more than three meters away from the locking device, the locking device may not be unlocked. The device may determine if the mobile phone is close enough (e.g., below a predetermined distance) before allowing the application to cause the locking device to be unlocked or alternatively, allowing a physical input device attached to the locking device to be used in order to unlock the locking device. In some embodiments, the locking device may alert the user if an unauthorized attempt was made to extract the locking device from the firearm. As used herein, an unauthorized attempt is an attempt to operate a locking device done by an unauthorized user. For example, an attempt to extract the locking device by a user not holding a smartphone that was associated with the locking device, or by a user that failed to be identified by the locking device using any other method. In the occasion of an unauthorized attempt for extracting the locking device from the firearm, the locking device may further be fastened in the fire arm, locking the locking device tighter.

In some embodiments, the locking device may be extracted (e.g., by the authorized user) only after providing an identifying code or a signal to the locking device. The code or signal may be provided by the mobile phone of the authorized user or may be provided to the locking device via an input device that is physically connected to the locking device, for example: a keypad, a button, a dial and/or a biometric scanner. When the authorized user provides the identification code (e.g., activates the application running on an associated mobile phone, dials a correct set of numbers or is identified by the biometric scanner) the locking device may be unlocked and extract from the fire arm as a single unit by using the cocking mechanism of the firearm.

A locking device according to some embodiments may include: a locking cartridge adapted to be inserted into a firing chamber, the locking cartridge may include a cartridge-like housing and a locking mechanism located in the cartridge-like housing. The locking mechanism may be operated to lock or unlock the locking device by an actuator controlled by a controller. Each of the actuator and the controller may be located inside the cartridge-like housing or may be located outside of the cartridge-like housing and connected to the locking mechanism via a connector passable through the firearm's cartridge extraction opening.

Figure 1B:
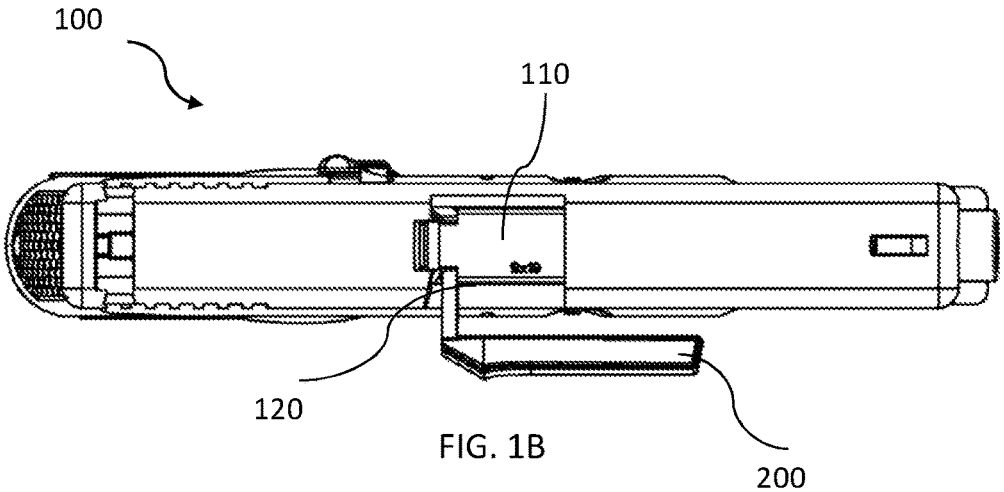

Reference is made to FIGS. 1A-1B that are illustrations of an isometric view and top view, respectively, of an exemplary locking device inserted in an exemplary firearm according to some embodiments of the invention. As used herein, the terms side view, top view etc. refers to a relative position of the locking device when the locking device is inserted in the fire arm and the fire arm is in a firing position (such that the barrel of the firearm is parallel to the ground, and the firearm's handle is directed towards the ground).

Figure 2A:
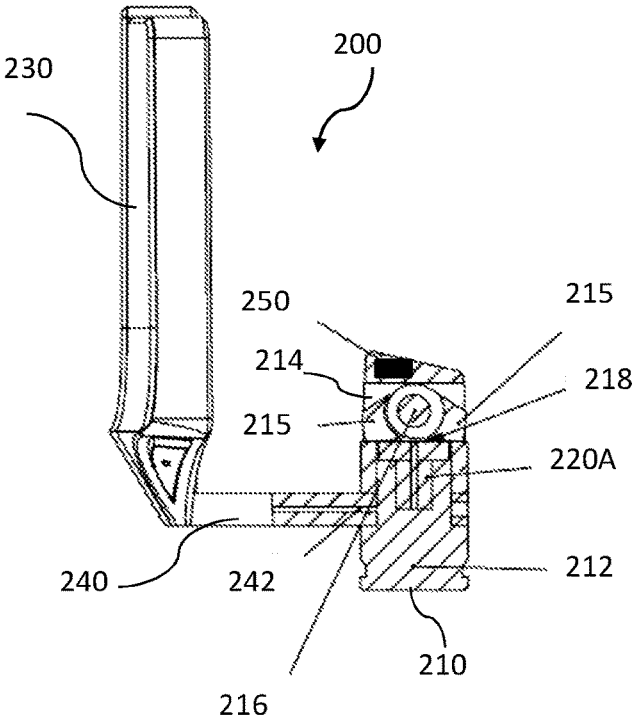
FIGS. 2A-2B are illustrations of an exemplary locking device according to some embodiments of the invention.
Figure 2B:
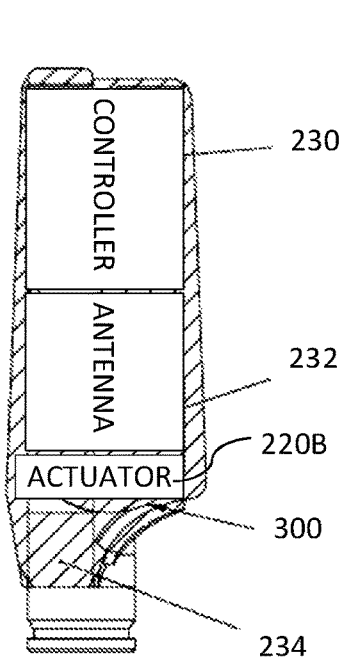

A locking device 200 may be inserted into a firearm 100 (e.g., a semi-automatic firearm) such that at least a first component of locking device 200 is inserted into a firing chamber 110 of firearm 100. Locking device 200 may be operated using input device 300, for example, a mobile phone. In some embodiments, a second component of locking device 200 may be located external to firing chamber 110 and connected to the first component via a connector passable through a firearm's cartridge extraction opening 120, as illustrated in FIGS. 2A-2B that are illustrations of top view and side view, respectively, of an exemplary locking device according to some embodiments of the invention. Locking device 200 may be extracted from firearm 100 as single unit, for example, by using the cocking mechanism of the firearm. Locking device 200 may be extracted from firing chamber 110 via cartridge extraction opening 120.

Locking device 200 may include a locking cartridge 210, an actuator 220A or 220B and a controller 230. Locking cartridge 210 may include a cartridge-like housing 212 and a locking mechanism 214 located in the cartridge-like housing 212. Cartridge-like housing 212 may have a shape of a cartridge to be inserted into the firearm. Therefore, for each firearm caliber, a dedicated cartridge-like housing 212 may be fabricated having the appropriate external diameter. Cartridge-like housing 212 may include a metallic housing made from any suitable alloy, for example, various steels, copper alloys etc.

Locking mechanism 214 may include any mechanism that is configured to lock locking cartridge 210 inside firing chamber 110 of firearm 100. Locking mechanism 214 may include any mechanism/arrangement/component that may cause locking mechanism 214 to be locked inside firing chamber 110 in the locked state and may be extractable from firing chamber 110 when the locking mechanism is in an unlocked state, for example, by cocking the firearm. Locking mechanism 214 may further include any mechanism/arrangement/component that may cause the locking mechanism to fasten in firing chamber 110 on an attempt to cock firearm 100, when locking mechanism 214 is in the locked state.

Figure 3A:
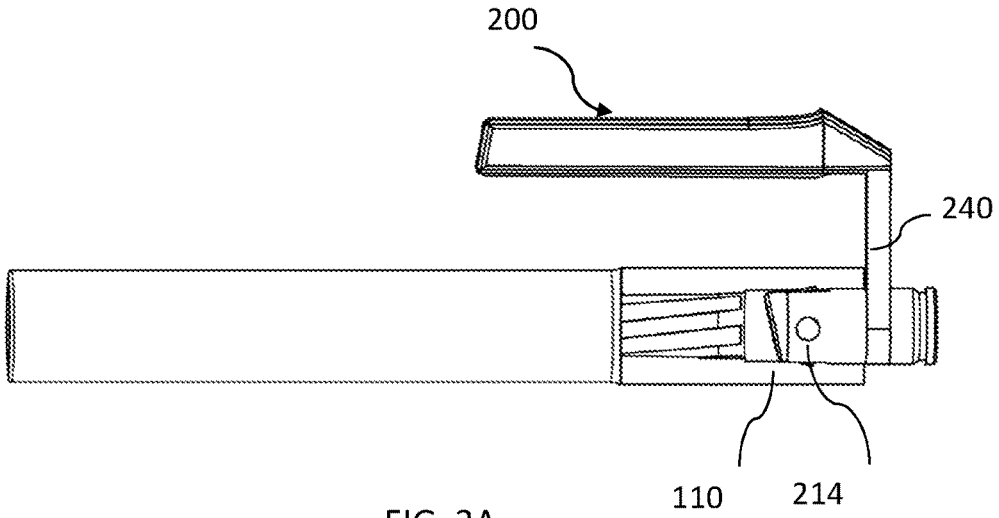
FIGS. 3A-3B are illustrations of an exemplary locking device in a locked and an unlocked states according to some embodiments of the invention.
Figure 3B:
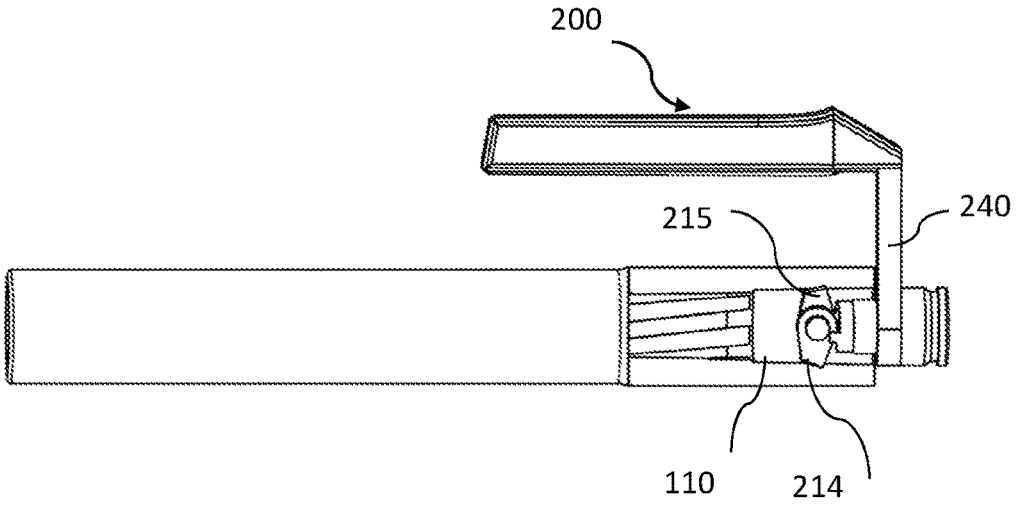

For example, locking mechanism 214 may include locking teeth 215 configured to be tightened against the walls of firing chamber 110 (as illustrated in FIG. 3B). Locking teeth 215 may be operated by a propulsion wheel 218 via a tooth axis 216, Propulsion wheel 218 may be operated by actuator 220A. In the exemplary locking device illustrated in FIG. 2A, actuator 220A is located inside cartridge-like housing 212 for direct operation of locking mechanism 210 by rotating propulsion wheel 218. In some other exemplary embodiments, the actuator, for example, actuator 220B may be located external to cartridge-like housing 212 and may be connected to locking mechanism 214 by a connector 240 passable through the cartridge extraction opening 110, such that when locking device 200 is inserted into firearm 100, actuator 220B may be located external to firearm firing chamber 110, for example, alongside firearm 100.

In yet another example, locking mechanism 214 may include a slotted cylinder (not illustrated) having an external diameter with approximately the caliber of firearm 100. The slotted cylinder is connected to a cartridge-like housing (e.g., having a shape of a cartridge base). The slotted cylinder may be configured to "extend" and tighten to the firing chamber's walls, when a cone inserted inside the slotted cylinder is being pulled in an attempt to extract the locking device from the firearm (e.g., by cocking the firearm). Locking mechanism 214 may further include at least one locking tooth for locking the locking mechanism; the locking tooth may be connected to the cartridge-like base and to a cable. The cable may be connected the locking tooth to an actuator located external to firearm firing chamber 110 (e.g., actuator 220B). The cable may be located inside a connector (e.g., connector 240) passable through the cartridge extraction opening 110.

It should be understood by any person skilled in the art that the two locking mechanisms disclosed above are given as an example only and embodiments of the invention are not limited to these two mechanisms. Any locking mechanism configured to fasten the locking mechanism in the firearm's firing chamber, upon an attempt to extract the locking mechanism when the locking mechanism is in a locked state and be extracted from the firing chamber as a single unit when the locking mechanism is in an unlocked state, can be used with the various embodiments of the present invention.

Actuator 220A and/or 220B may be any actuator adapted to change the state of locking mechanism 214 from the locked state to the unlocked state and vice versa. Actuator 220A and/or 220B may include a system for converting electrical energy to mechanical movement. For example, actuator 220A and/or 220B may be an electric motor, a piezoelectric device, a Shape-memory alloy, or the like. Actuator 220A or 220B may be located inside cartridge-like housing 212 or located external to the cartridge-like housing and connected to locking mechanism 214 by connector 240 passable through cartridge extraction opening 120 such that when locking device 200 is inserted into firearm 100, actuator (e.g., 220B) is located external to the firearm firing chamber, for example, alongside the firearm.

In some embodiments, locking cartridge 210, actuator 220A or 220B and controller 230 may be extracted from the firearm together as a single unit. Connector 240 may connect components of locking device 200 inserted in firing chamber 110 with components located external to firing chamber 110, for example, located alongside firearm 100. Connector 240 may be passable through cartridge extraction opening 120. Locking device 200 may be extracted from the firearm, by cocking the fire arm. In some embodiments, all the various components of locking device 200 may be located inside cartridge like hosing 212, such that entire locking device 200 may be inserted in firing chamber 110.

Controller 230 may be any processing device in active communication with actuator 220A or 220B and configured to operate actuator 220A or 220B according to a signal received from an input device (e.g., input device 300). Controller 230 may include a processor and a memory for storing instructions to be executed by the processor. For example, instructions for, operating actuator 220A or 220B to lock locking device 220 inside firing chamber 110 using locking mechanism 214 upon receiving a first signal from an input device to lock locking device 200 and operating actuator 220A or 220B to unlock the locking device inside the firing chamber by releasing locking mechanism 214 upon receiving a second signal from the input device to unlock locking device 200.

Controller 230 may be located inside cartridge like housing. Alternatively, controller 230 may be located external to the firing chamber, for example, alongside the firearm, and connector 240 passable through the firearm's cartridge extraction opening 120 may connect locking cartridge 210 and controller 230. Connector 240 may include communication line 242 to communicate actuator 220A and controller 230. Therefore, when the locking device 200 is inserted into firearm 100, locking cartridge 210 may be located in the firearm's firing chamber and controller 230, may be located external to the firing chamber as illustrated in FIG. 1A.

Input device 300 according to some embodiments of the invention may be any device that is configured to send signals to controller 230. Input device 300 may be a mobile device, connected to the controller via wireless communication, as illustrated in FIG. 1A.

In some embodiments, controller 230 may be configured to identify the mobile device as an "authorized device" and may be configured to receive signals to operate actuator 220A or 220B only from an authorized mobile device.

Input device 300, may be a mobile device in wireless communication with locking device 200 or may be integral to and physically connected to locking device 200. Mobile input device 300 may be a mobile phone, a tablet, a laptop computer, a remote control, or any other mobile device configured to send signals using wireless communication. The wireless communication may include, Bluetooth communication, WiFi communication, cellular communication, GSM communication, ZigBee communication, NFC communication, RADIO communication, RFID communication, satellite communication, ANT communication, Z-WAVE communication, or any other communication protocol or frequency known in the art.

In some embodiments, input device 300 may be physically connected to the locking device, as illustrated in FIG. 2B. A physically connected input device 300 may include at least one of a list consisting of: a keypad, a button, a dial, a knob, a biometric scanner, and the like. Physically connected input device 300 may include a mechanism for identifying an authorized user. For example, the user may be identified using: a biometric scanner programmed with biometric data of the authorized user, a dial programmed with a code known only to authorized users, a sequence of button presses, known only to authorize users, that has to be pressed for controller 230 to identify the authorized user, etc. Following the identification of the user, input device 300 may send signals to controller 230, for example, signals to lock or unlock locking device 200.

In some embodiments, the physically connected input device may become active in case the input mobile input device is out of order (e.g., a battery of a mobile phone is running low). In some embodiments, the physically connected input device may have higher priority than the mobile input device such that an instruction received from the physically connected input device may overrule an instruction received the mobile input device (e.g., to unlock the locking device) and vice versa.

In some embodiments, input device 300 may operate locking device from a distance, by sending signals to controller 230 to operate actuator 220A or 220B. For example, in a case of a burglary (e.g., to a home), when the authorized user (e.g., one parent, a policeman, etc.) is not present, another user (e.g., the other parent) may ask the authorized user to remotely operate and unlock the locking device. In some embodiment, an additional code or identification, know to the other user, may be required to unlock the locking device, for example, a code dialed into a dial included in locking device. This may be done in order to prevent a third user (e.g., a child) from unlocking the locking device. In some embodiments, in order to unlock locking device 200 at least two signals may have to be received from at least two input devices (e.g., a mobile phone and a biometric sensor or scanner, or two different mobile phones).

In some embodiments, locking device 200 may include an antenna 232. Antenna 232 may be any radiating element that is configured to send and/or receive electromagnetic signals (e.g., in a radio-frequency (RF) range). Antenna 232 may be configured to send and/or receive signals to and/or from input device 300 (e.g., Bluetooth signals or other RF signals received from a mobile device). Additionally or alternatively antenna 232 may be configured to send and/or receive signals to and/or from other devices, for example, a localization signal (e.g., a GPS signal) from a satellite. Antenna 232 may be in communication with controller 230 such that controller 230 may be configured to send and/or receive signals to and/or from input device 300 via antenna 232. In some embodiments, locking device 200 may include more than one antenna 232, for example, an antenna for sending/receiving Bluetooth signals and an antenna for sending/receiving GPS signals.

In some embodiments, antenna 232 may be located external to cartridge-like housing 212, such that when cartridge-like housing 212 is inserted into firing chamber 110, antenna 232 is external to firearm 100 (as illustrated in FIG. 2B). In some embodiments, controller 230 may be located in cartridge-like housing 212 and antenna 232 may be located external to cartridge-like housing 212, therefore, antenna 232 may be connected to controller 230 via connector 240 passable through cartridge extraction opening 120 and communication line 242 may communicate antenna 232 to controller 230. In some embodiments antenna 232 may be located in cartridge-like housing 212 and controller 230 may be located either in cartridge-like housing 212 or external to cartridge-like housing 212.

In some embodiments, antenna 232 may be located internal to cartridge-like housing 212 and in or in proximity to firearm 100 muzzle, such that the RF communication may be received and transmitted via the muzzle. Electromagnetic waves may propagate in the muzzle, on their way to or from antenna 232. In some embodiments, firearm 100 metallic body may act as antenna 232. The metallic body may serve as a receiving-transmitting device, e.g. for RF communication.

In some embodiments, antenna 232 may be configured to receive localization signals (e.g., GPS signals) related to a location of firearm 100 and/or locking device 200 and controller 230 may be configured to report (e.g., to a user) the location of firearm 100 and/or locking device 200 via input device 300. For example, one or more antennas 232 may receive GPS signal indicative of the location of locking device 200 (e.g., outside of the authorized user's home) and the controller may send via the one or more antennas 232 signal to the authorized user mobile device alerting that locking device 200 and firearm 100 were taken out of the authorized user home. In some embodiments, the alerting signal may be a dynamic signal and the authorized user may follow (track) a change in the location of locking device 200.

In some embodiments, locking device 200 may include a sensor 250 configured to sense a condition of locking device 200. The condition of locking device 200 may include, relative positioning of locking device 200, a state of the locking device (e.g., locked/unlocked state), a condition of one or more of the components included in locking device 200 (e.g., actuator 220A or 220B is malfunctioned) or the like. Exemplary conditions of locking device 200 may include at least one of: locking device 200 is not inserted in firearm 100, locking device 200 is in firearm 100 in the unlocked state, locking device 200 is in firearm 100 in the locked state and an attempt was done to extract locking device 200 from firearm 100 when the locking device is in the locked state. In some embodiments, device 200 may include more than one sensor 250.

Sensor 250 may include any sensing device for sensing the condition of locking device 200. For example, sensor 250 may include Micro Electro Mechanical System (MEMS), a strain gauge, a temperature sensor, or the like. Such one or more sensors may sense if the locking device is inserted into the firing chamber. Sensor 250 may further be an acceleration sensor or any other sensor configured to sense the movement of locking device 200 in firing chamber 110, for example, in an attempt to extract the device by a non-authorized user.

Sensor 250 may sense attempts to sabotage locking device 200, for example, an attempt to burn or cause a short-circuit in controller 230 of locking device 200 may be sensed using a temperature sensor, located in proximity to the controller. In some embodiments, sensor 250 may be or may be a included in a transceiver connected to antenna 232 and may further be configured to detect changes in the communication signal received by antenna 232. In such case, the sensor may sense an attempt to violet, interfere and/or bypass the communication between locking device 200 and input device 300 (e.g., mobile device). In some embodiments, controller 230 may be configured to identify such interference even without the presence of sensor 250 on antenna 232. For example, controller 230 may detect an attempt of an unauthorized communication network to communicate and activate locking device 200.

Sensor 250 may be in communication with controller 230, such that controller 230 may send input device 300 a notification regarding the condition (e.g., report the condition) of locking device 200 and/or send an alert if the condition has been changed. For example, the authorized user may receive to its mobile phone an alert that: an attempt was made to extract the locking device from the firearm, an attempt was made to burn locking device 200, an unauthorized communication network is/was trying to communicate with locking device 200, or the like.

In some embodiments, controller 230 may be configured to receive a signal indicative of a distance between input device 300 (e.g., a mobile input device) and locking device 200. The distance between the input device and the locking device may be determined using a localization signal (e.g., GPS system) or other signals such as Zigbee-Ground-Penetrating Radar (GPR) location-based services, Sound Ranging, Radio Detection and Ranging (RADAR), Sound Navigation and Ranging (SONAR), Assigned-GPS (AGPS) or the like, using antenna 232 and/or sensor 250. After determining the distance the controller may determine if the distance is smaller than a predetermined threshold value (e.g., 10 meters), indicating that the authorized user carrying the mobile input device is close to locking device 200. If the distance is smaller than a predetermined threshold value the controller may operate the actuator to unlock the locking. Additionally or alternatively, the controller may follow a signal received (e.g., to lock or unlock device 200) only if the distance is smaller than a predetermined threshold value. The signal may be sent from either the mobile input device or the physically connected input device.

In some embodiments, locking device 200 may be used as an emergency reporting system. A user (either authorized or not) may use physically connected input device 300 to send an emergency call, for example, by dialing an emergency code (e.g., 911) or pressing a button for a period of 30 seconds, or the like. Controller 230 may recognized the code as an emergency code and may send via antenna 232 a signal to an emergency service provider (e.g., the police) and/or to the mobile input device of the authorized user. In some embodiments, such a signal may include localization information regarding the location of locking device 200 in order to assist the emergency service provider to arrive to the user sending the emergency call as quickly as possible.

In some embodiments, locking device 200 may further include a physical cable hole (known in the art as "laptop lock Slot") and a key for locking a cable inserted in locking-device 200. The cable may anchor locking device 200 and firearm 100 to a physical anchoring device (e.g., a ring attached to a wall) to prevent any unauthorized user from taking (e.g., steeling) locking device 200 (and firearm 100).

Reference is made to FIGS. 3A-3B that are illustrations of an exemplary locking device in a locked and unlocked states according to some embodiments of the invention. In FIG. 3A, locking device 200 is inserted to firearm 100 such that locking cartridge 210 is inside firing chamber 110, in an unlocked state. Any attempt to cock firearm 100 may result in extraction of locking device 200 from the fire arm, as single unit. In FIG. 3B locking device 200 is in a locked state such that teeth 215 of locking mechanism 214 are open against the walls of firing chamber 110. Any attempt to cock firearm 100 may result in further fastening locking mechanism 214 in firing chamber 110.

In some embodiments, locking device 200 may further include a battery (not illustrated) for supplying electric power to controller 230, actuator 230 and/or input device 300 physically connected to the locking device (as illustrated in FIG. 2B). In some embodiments, locking device 200 may further include a lamp 234 (e.g., a Light Emitting Diode (LED)) for notifying the user a condition of the locking device. For example, lamp 234 may be lightened up when device 200 is locked in firing chamber 110. In yet another example, lamp 234 may flicker when an attempt have been made to extract device 200 when the device is locked in firing chamber 110. The battery may also power lamp 234.

In some embodiments, the battery may be a long living battery (e.g., at least five years) and the application running on mobile device 300 may be configured to notify the user what is the life expectancy of the battery. For example, every time the user locks or unlocks firearm 100 using the application, a notification reading the life expectancy (e.g., 11 month) may popup. In some embodiments, when the life expectancy of the battery drops below a first predetermined threshold (e.g., below six month) the application may give an additional notification to the user, demanding that before the user operates locking device 200, the user may have to send the application a notification that he/she is aware to the short life expectancy of the battery. In some embodiments, when the life expectancy of the battery drops below a second predetermined threshold (e.g., one month) locking device 200 may be operated only using physically connected input device 300. In some embodiments, locking device 200 may further include two electric triggers (+ and −, not illustrated) that may power locking device 200, at least to be operated by physically connected input device 300, thus allowing locking device 200 to be extracted only by an authorized user even if the battery ran out of power when device 200 is locked in firearm 100.

Figure 4:
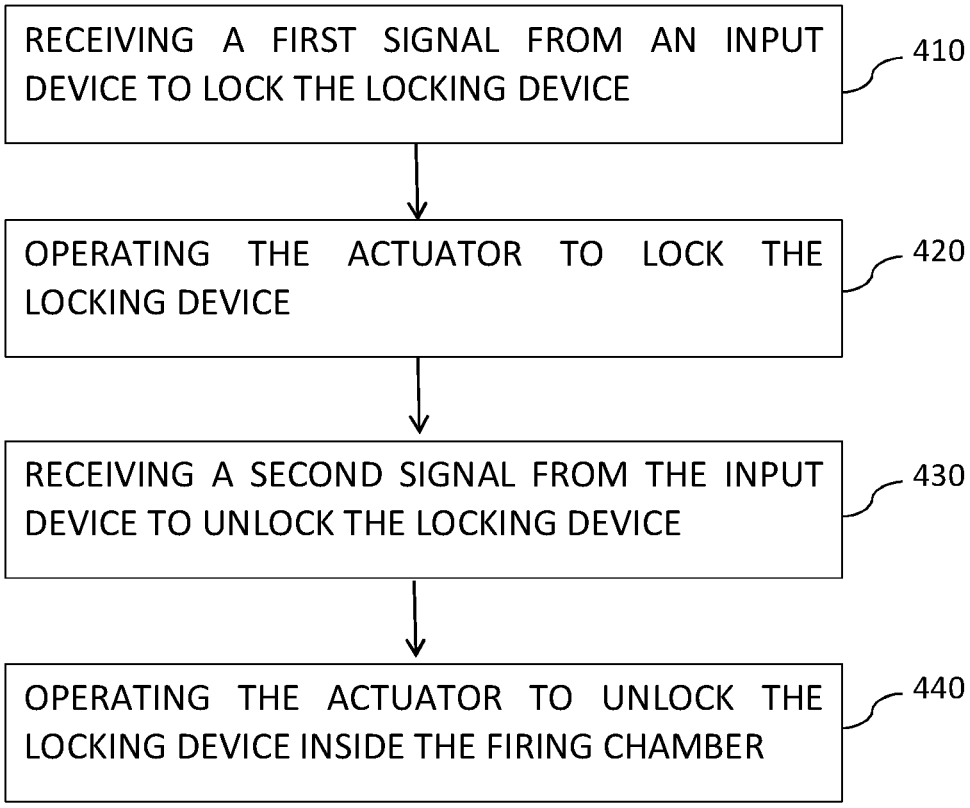
FIG. 4 is a flowchart of a method of controlling a locking device according to some embodiments of the invention.

Reference is made to FIG. 4 which is a flowchart of a method of controlling a locking device for locking a firearm. The method of FIG. 4 may be executed by controller 230, or may be executed by any other controller for controlling a locking device. Instructions of the method may be stored in a memory associated with the controller. Locking device 200 may be inserted into firing chamber 110 for locking firearm 100. In step 410, the method may comprise receiving a first signal from an input device (e.g., input device 300) to lock locking device 200. Locking device 200 may include a locking cartridge 210, an actuator 220A or 220B and a controller 230. The first signal may be an electromagnetic (EM) signal received via wireless communication from a mobile input device. Additionally or alternatively the signal may be received from an input device physically connected to the locking device. In some embodiments, more than one first signal may have to be received from one or more input devices. For example, two first signals may have to be received from two mobile phones, a mobile phone and a button located in the locking device, or the like.

In step 420, the method may include operating actuator 220A or 220B to lock locking device 200 inside firing chamber 110 of firearm 100 using a locking mechanism 214. Actuator 220A and/or 220B may cause the movement of an element included in the locking mechanism (e.g., teeth 215), such that locking cartridge 210 may tighten against the walls of firing chamber 110. In some embodiments when locking mechanism 214 is in a locked state, cocking firearm 100 may fasten and/or tighten the locking mechanism in the firearm's firing chamber 110.

In step 430, the method may include receiving a second signal from input device 300 to unlock locking device 200. The second signal may be an EM signal received via wireless communication from a mobile input device. Additionally or alternatively the second signal may be received from an input device physically connected to the locking device. In some embodiments, more than one second signal may have to be received from one or more input devices. For example, two second signals may have to be received from two mobile phones, a mobile phone and a button located in the locking device, or the like. For example, if a teenager wants to unlock the locking device of a firearm in a position of his family, two signals may have to be received, one from the teenager's mobile phone and one from a parent mobile phone.

In step 440, the method may include operating actuator 200 to unlock locking device 200 inside firing chamber 100 by releasing locking mechanism 214. In some embodiments, when locking mechanism 200 is in an unlocked state, locking device 200 may be extractable from the firearm's firing chamber 110, by cocking firearm 100.

In some embodiments, the method may further include determining if the locking device is inserted into the firing chamber. Locking device 200 may include at least one sensor 250 that is capable of sensing a condition or the state of the locking device, for example, if the locking device is in the firearm, if the locking device is in the locked or unlocked state, etc. In some embodiments, the method may include sending signals indicative of the state (e.g., locked or unlocked) of the locking device to input device 300.

In some embodiments, the method may include receiving from sensor 250 located in the locking device a signal indicative of a condition of the locking device. The condition may be at least one of: the locking device is not inserted in the firearm, the locking is in the fire arm in the unlocked state, the locking device is in the fire arm in the locked state and an attempt was done to extract the locking device when the locking device is in the locked state. In some embodiments, the method may further include sending to the input device (e.g., a mobile device) a notification regarding (e.g., a signal indicative of) the condition of the locking device. For example, the authorized user may receive to his mobile phone, tablet, or laptop an alert when an attempt was done to extract the locking device when the locking device is in the locked state.

In some embodiments, the method may include receiving localization signals related to a location of the firearm, for example, a GPS signal received by an antenna 232 in communication with controller 230. The method may further include reporting the location of the firearm by sending a signal to the input device. For example, firearms in the possession of a security company may be track by a supervisor using localization signals received from locking devices inserted in each firearm.

In some embodiments, the method may include receiving a signal indicative of a distance between the input device and the locking device. The signal may be a localization signal (e.g., GPS signal) or another signal. The signals may be received from antenna 232 and/or sensor 250. In some embodiments the method may include operating actuator 220A or 220B to unlock locking mechanism 214 if the distance is smaller than a predetermined threshold value, for example, smaller than 2 meters.

What is claimed is:

1. A locking device for a firearm, the locking device comprising:

a locking cartridge adapted to be inserted into a firing chamber of the firearm, the locking cartridge comprising a cartridge shaped housing and a locking mechanism located in the cartridge shaped housing and configurable between an unlocked state in which the locking mechanism is extractable from the firing chamber, and a locked state in which the locking mechanism is configured to be fastened within the firing chamber;

an actuator configured for changing a state of the locking mechanism between the locked state and the unlocked state;

a controller in communication with the actuator, configured to control the actuator;

and a connector having a first end connected to the locking cartridge and a second end connected to the controller;

wherein at the unlocked state of the locking mechanism, the locking cartridge is extractable from the firing chamber by using a cocking mechanism of the firearm.

2. The locking device according to claim 1, wherein said connector is laterally extending from the cartridge shaped housing, such that when the locking device is inserted into the firearm, the locking cartridge is located in the firing chamber and the controller is located external to the firing chamber alongside the firearm.

3. The locking device according to claim 1, wherein the connector has a passage configured for establishing communication between the controller and the locking mechanism.

4. The locking device according to claim 3, wherein the actuator is located in the cartridge shaped housing, and the passage is configured for establishing communication between the controller and the actuator.

5. The locking device according to claim 3, wherein the actuator is located external to the cartridge shaped housing, and the passage is configured for establishing communication between the actuator and the locking mechanism.

6. The locking device according to claim 1, wherein at the unlocked state of the locking mechanism, the locking device is extractable from the firing chamber by cocking the firearm.

7. The locking device according to claim 1, wherein at the locked state of the locking mechanism, the locking device is configured to be fastened in the firing chamber by cocking the firearm.

8. The locking device according to claim 1, wherein the controller is configured to:

receive a first signal to lock the firearm and instruct the actuator to lock the locking mechanism by causing the locking mechanism to assume the locked state; and receive a second signal to unlock the firearm and instruct the actuator to unlock the locking mechanism by causing the locking mechanism to assume the unlocked state.

9. The locking device according to claim 1, further comprising a sensor configured to sense a condition of the locking device.

10. The locking device according to claim 9, wherein said condition is one or more of the following:

the locking device is not inserted in the firearm;

the locking device is in the firearm at the unlocked state;

the locking device is in the firearm at the locked state; or an attempt was done to extract the locking device when the locking device is at the locked state.

11. The locking device according to claim 9, wherein the sensor is in communication with the controller and the controller is configured to report the condition of the locking device via an input device.

12. The locking device according to claim 1, wherein the controller is configured to:

receive a signal indicative of a distance between an input device and the locking device; and instruct the actuator to unlock the locking mechanism by causing the locking device to assume the unlocked state when the distance is smaller than a predetermined threshold value.

13. A locking device for a firearm, the locking device comprising:

a locking cartridge adapted to be inserted into a firing chamber of the firearm, the locking cartridge comprising a cartridge shaped housing and a locking mechanism located in the cartridge shaped housing and configurable between an unlocked state in which the locking mechanism is extractable from the firing chamber, and a locked state in which the locking mechanism is configured to be fastened within the firing chamber;

an actuator configured for changing a state of the locking mechanism between the locked state and the unlocked state; and a controller in communication with the actuator, and configured to control the actuator according to a signal received from an input device;

wherein at the unlocked state of the locking mechanism, the locking device is extractable from the firing chamber as one unit by using a cocking mechanism of the firearm; and wherein at the locked state of the locking mechanism, the locking device is configured to be fastened in the firing chamber also by using the cocking mechanism of the firearm.

14. The locking device of claim 13, wherein the cartridge shaped housing has a slot at a base portion thereof, whereby cocking the firearm at the locked state of the locking mechanism results in tightening the locking cartridge against walls of the firing chamber, thereby fastening the locking cartridge in the firing chamber.

15. The locking device of claim 13, further comprising a connector having a first end connected to the locking cartridge and a second end connected to the controller.

16. A method for locking a firearm by a locking device including a locking cartridge comprising a cartridge shaped housing and a locking mechanism located in the cartridge shaped housing and configured for assuming an unlocked state and a locked state; an actuator adapted to change a state of the locking mechanism between the locked state and the unlocked state; and a controller in active communication with the actuator; said method comprising:

inserting the locking cartridge into a firing chamber of the firearm;

receiving a first signal from an input device at the controller to unlock the locking device;

instructing the actuator by said controller to cause the locking mechanism to assume the unlocked state inside the firing chamber of the firearm, so that by using a cocking mechanism of the firearm, the locking device is extractable from the firing chamber as one unit;

receiving a second signal from the input device at the controller to lock the locking device; and instructing the actuator by said controller to cause the locking mechanism to assume the locked state inside the firing chamber, so that by using the cocking mechanism of the firearm, the locking device is fastened in the firing chamber.

17. The method of claim 16, further comprising:

wherein the cartridge shaped housing has a slot at a base thereof;

engaging the cocking mechanism in the slot;

cocking the firearm at the locked state of the locking mechanism, thereby tightening the locking cartridge against walls of the firing chamber; and fastening the locking cartridge in the firing chamber.

18. The method of claim 16, further comprising determining if the locking device is inserted into the firing chamber.

19. The method of claim 16, further comprising:

sending signals indicative of a state of the locking device to the input device.

20. The method of claim 16, further comprising:

receiving a signal indicative of a distance between the input device and the locking device: and instructing the actuator to unlock the locking mechanism if the distance is smaller than a predetermined threshold value.

* * * * *